US006115848A

United States Patent [19]

Key

[11] Patent Number: 6,115,848

[45] Date of Patent: Sep. 12, 2000

[54] SNORKELING/SCUBA MASK WITH LIQUID DIRECTING MEMBER

[76] Inventor: Mark B. Key, 6434 Harting Overlook, Indianapolis, Ind. 46237

[21] Appl. No.: 08/980,680

[22] Filed: Dec. 1, 1997

[51] Int. Cl.[7] ..... A61F 9/02

[52] U.S. Cl. ..... 2/428; 2/435

[58] Field of Search ..... 2/428, 441, 443, 2/430, 429

[56] References Cited

U.S. PATENT DOCUMENTS

| | | | |
|---|---|---|---|
| 2,333,336 | 11/1943 | Powell . | |
| 2,362,917 | 11/1944 | Malcom . | |
| 2,524,245 | 10/1950 | Wold . | |
| 3,143,739 | 8/1964 | Beuchat . | |
| 3,336,599 | 8/1967 | Gatti et al. | 2/439 |
| 3,755,819 | 9/1973 | Douglas | 2/428 |
| 4,077,068 | 3/1978 | Anderson | 2/428 |
| 4,087,865 | 5/1978 | Garofalo . | |
| 4,689,837 | 9/1987 | Bollé . | |
| 5,564,130 | 10/1996 | Feng | 2/428 |
| 5,572,989 | 11/1996 | Lutz et al. . | |
| 5,581,822 | 12/1996 | Tagyo . | |
| 5,603,124 | 2/1997 | Garofalo | 2/428 |
| 5,638,552 | 6/1997 | Fujima | 2/428 |
| 5,642,529 | 7/1997 | Fujima | 2/428 |

*Primary Examiner*—Danny Worrell
*Attorney, Agent, or Firm*—Woodard, Emhardt, Naughton Moriarty & McNett

[57] ABSTRACT

In one embodiment of the present invention a water activity mask has a transparent visor and a pliable frame defining an interior volume. One end of the frame rests flush against the wearer's face, forming a substantially watertight seal. The interior of the mask contains a fluid directing member extending towards the visor from the inner surface of the mask. In use the fluid directing member normally retains and prevents liquid in the mask from coming into contact with the wearer's face. The liquid is generally used to defog the mask as necessary.

18 Claims, 4 Drawing Sheets

SNORKELING/SCUBA MASK WITH LIQUID DIRECTING MEMBER

BACKGROUND OF THE INVENTION

The present invention relates in general to the design and construction of a mask to be warn during activities in water. More specifically, one form of the present invention defines a diving mask for facilitating under water vision. Although the present invention was developed for use in diving masks, certain applications may be outside of this field.

A conventional diving mask fits over the diver's face to encompass the eyes and often the nose. During use, a typical diving mask forms a nearly watertight seal with the diver's face. A quantity of water remains in the mask and is often used by the diver to clear the mask's viewing pane, which has a tendency to fog. A common limitation associated with many mask designs is that the water retained in the mask for clearing the fog away tends to irritate the diver's face. It is well known that divers will use the water to defog the mask, however the water generally lays against the diver's face and can cause vision and skin irritation. The facial irritation problems are compounded when the water is not fresh water and/or contains pollutants.

Even with a variety of earlier mask designs, there remains a need for a diving mask to retain a defogging liquid within the mask for defogging purposes, but to retain it in such a way so as to prevent irritation to the facial skin and eyes. The present invention satisfies this need in a novel and unobvious way.

SUMMARY OF THE INVENTION

To address the unmet needs of prior masks, one embodiment of the present invention contemplates a mask for wearing by a person to cover their eyes during water activities. The mask comprising: a frame having a first portion adapted for abutting a person's face to normally provide a substantially fluid tight enclosed volume adjacent the face and a second portion spaced from the first portion; a viewing portion coupled to the second portion of the frame; and a liquid directing member coupled to the frame proximate the viewing member and extending into the substantially enclosed volume for minimizing the movement of liquid within the enclosed volume to the person's eyes.

Another form of the present invention contemplates a combination, comprising: a substantially waterproof mask having a pliable frame adapted for engaging a person's face to define a substantially fluid tight enclosed volume adjacent at least a portion of the person's face; and a liquid accumulation reservoir within said substantially enclosed volume for normally retaining liquid within the substantially enclosed volume so as to minimize the liquid contacting the person's face.

One object of the present invention is to provide an improved diving mask.

Related objects and advantages of the present invention will be apparent from the following description.

DESCRIPTION OF THE PREFERRED EMBODIMENT

Figure 1:
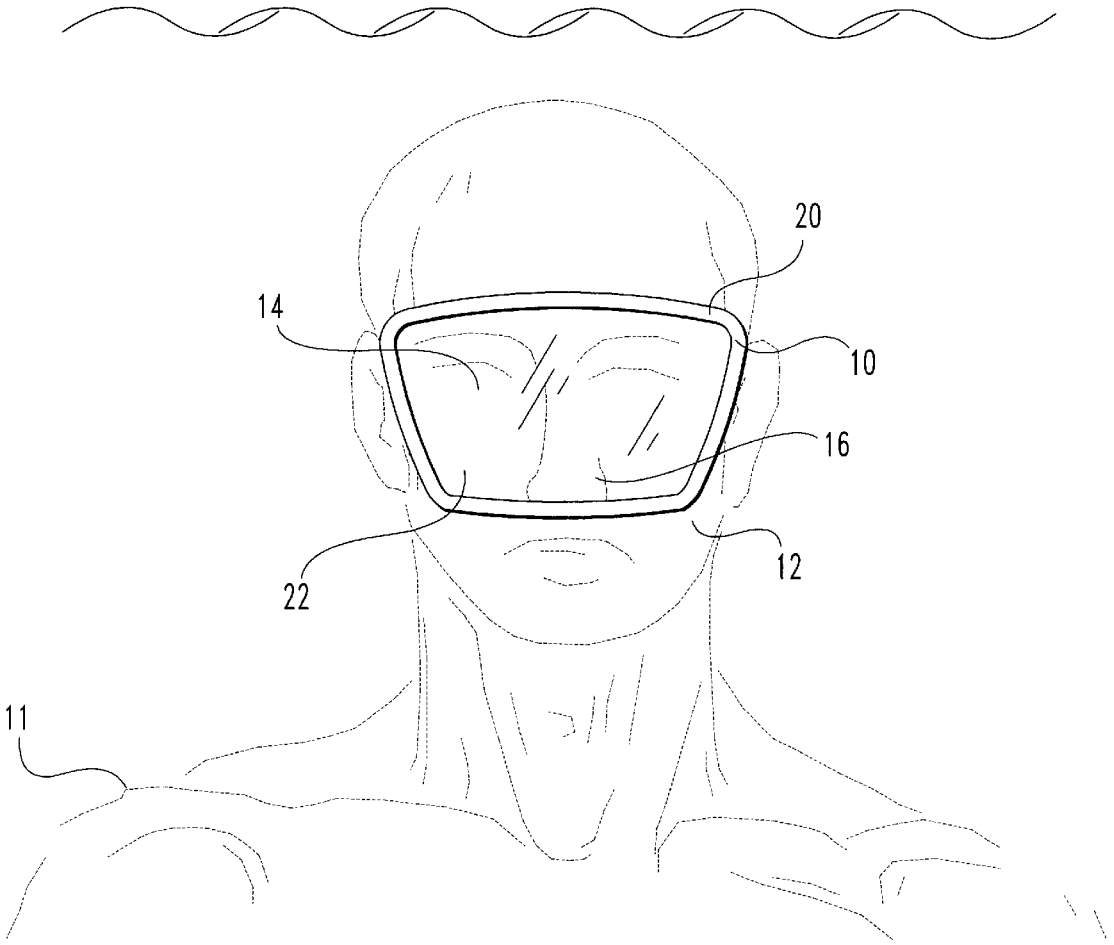
FIG. 1 is a front elevational view of one embodiment of a diving mask of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
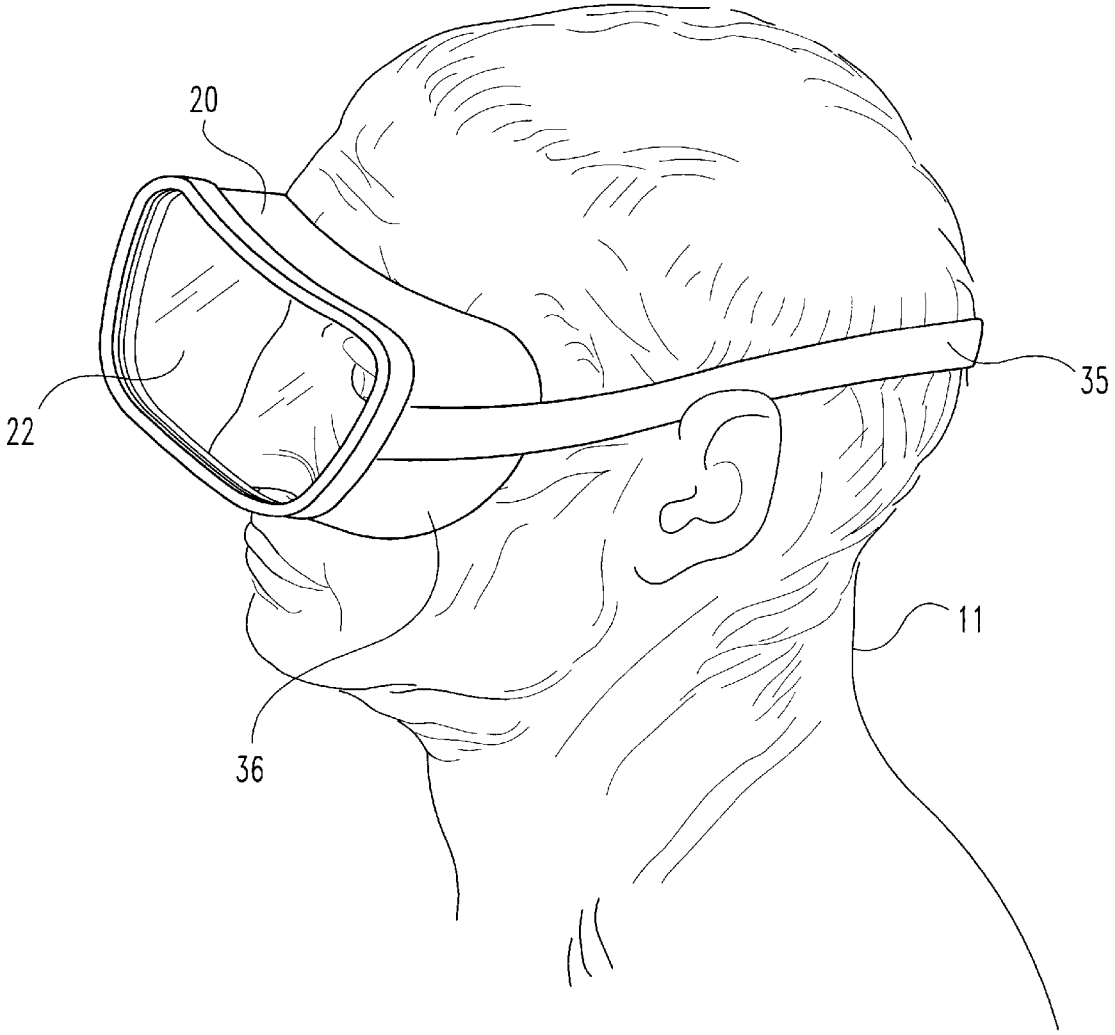
FIG. 2 is perspective view of the diving mask of FIG. 1.
Figure 3:
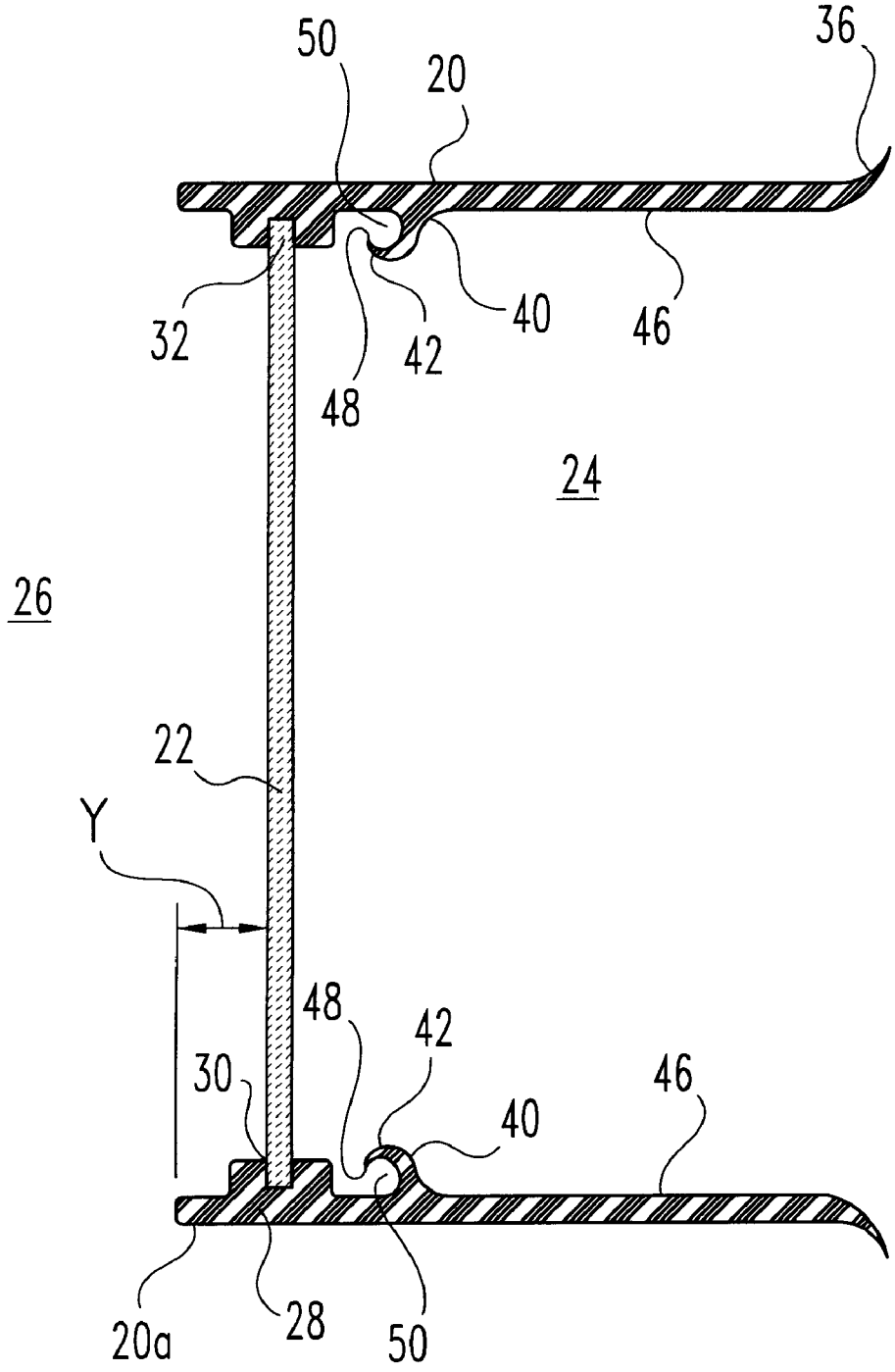
FIG. 3 is a cross-sectional view of the FIG. 2 mask.

With reference to FIGS. 1–3, there is illustrated one embodiment of a mask 10. The mask 10 is designed and constructed to normally be worn by a diver 11 flush against the face 12, and is intended to cover the eyes 14 and nose 16. A strap 35 normally holds the mask 10 in place on the divers head. The mask 10 is intended to minimize the exposure of the wearer's face to fluids, such as water, and thereby enhance the wearer's vision. More particularly, the mask 10 is designed as a diving masks for scuba, snorkeling, swimming and other recreational activities that normally take place in water.

The mask 10 includes a frame portion 20 and a viewing portion 22. In one form of the mask 10 the frame portion 22 is formed of a pliable material, and the viewing portion is formed of a material that can be looked through by the human eye. In a more preferred form of the present invention the frame portion 20 is formed of a molded elastomeric material. More specifically, in one embodiment the viewing portion 22 is defined by a transparent pane 22. In alternative embodiments the viewing portion 22 may be shaded or have other characteristics which reduce and/or change the degree of viewability therethrough. However, it is understood herein that a normal user of the mask will be able to view, at least to some extent, through the viewing portion 22. The frame portion 20 and the viewing portion 22 being coupled together so as to form a substantially fluid tight joint.

A part 36 of the frame portion 20 abuts the wearers face. In one form the part 36 fits flush against the wearer's face 12 to produce a substantially fluid tight seal. An enclosed volume 24 is defined within the mask 10 adjacent the wearers face. The frame portion 20 has a first end 20*a* with an opening 26 formed therein. The frame portion 20 has a proturbance 28 with a channel 30 formed therein for receiving the viewing portion 22. In one form of the present invention the channel 30 is defined by an endless groove 30 that is spaced a distance 'Y' from the opening 26. An edge 32 of the viewing portion 22 is positioned within the groove 30. The mask 10 having a substantially rectangular shape, however other geometric shapes are contemplated herein.

A fluid directing member 42 is positioned proximate the viewing portion 22 to normally maintain the liquid within the mask 10 away from the divers face. In one form of the mask 10 the fluid directing member 42 is positioned proximate the proturbance 28. In one embodiment, the fluid directing member 42 extending around the interior surface 46 of the frame portion 20. However, in an alternate embodiment the fluid directing member only extends around a portion of the interior surface of the frame portion 20. In one form of the present invention a first end 40 of the fluid directing member 42 is coupled to the interior surface 46, and a second end of the fluid directing member 42 extends into the enclosed volume 24. In a more preferred form of the mark the fluid directing member 42 is formed integral with the frame portion 20, such as by molding the frame portion 20 and the fluid directing member 42 in a unitary piece. The fluid directing member 42 and the inner surface 46 of the frame portion defining a fluid reservoir 50 for normally receiving and holding liquids within the mask 10. In one form of the mask 10 the fluid reservoir has a fairly constant volume along the interior surface of the frame portion 20. However, in an alternate embodiment the fluid reservoir is not uniform in volume along the interior surface of the frame portion 20. The volume of the reservoir 50 is sized so as to normally hold a quantity of liquid that is accumulated in the mask for use in clearing the viewing portion 22. In a preferred form of mask 10 the fluid directing member 42 has a tip portion 48 formed thereon that is directed back towards the interior surface 46 of the frame portion 20.

Figure 2A:
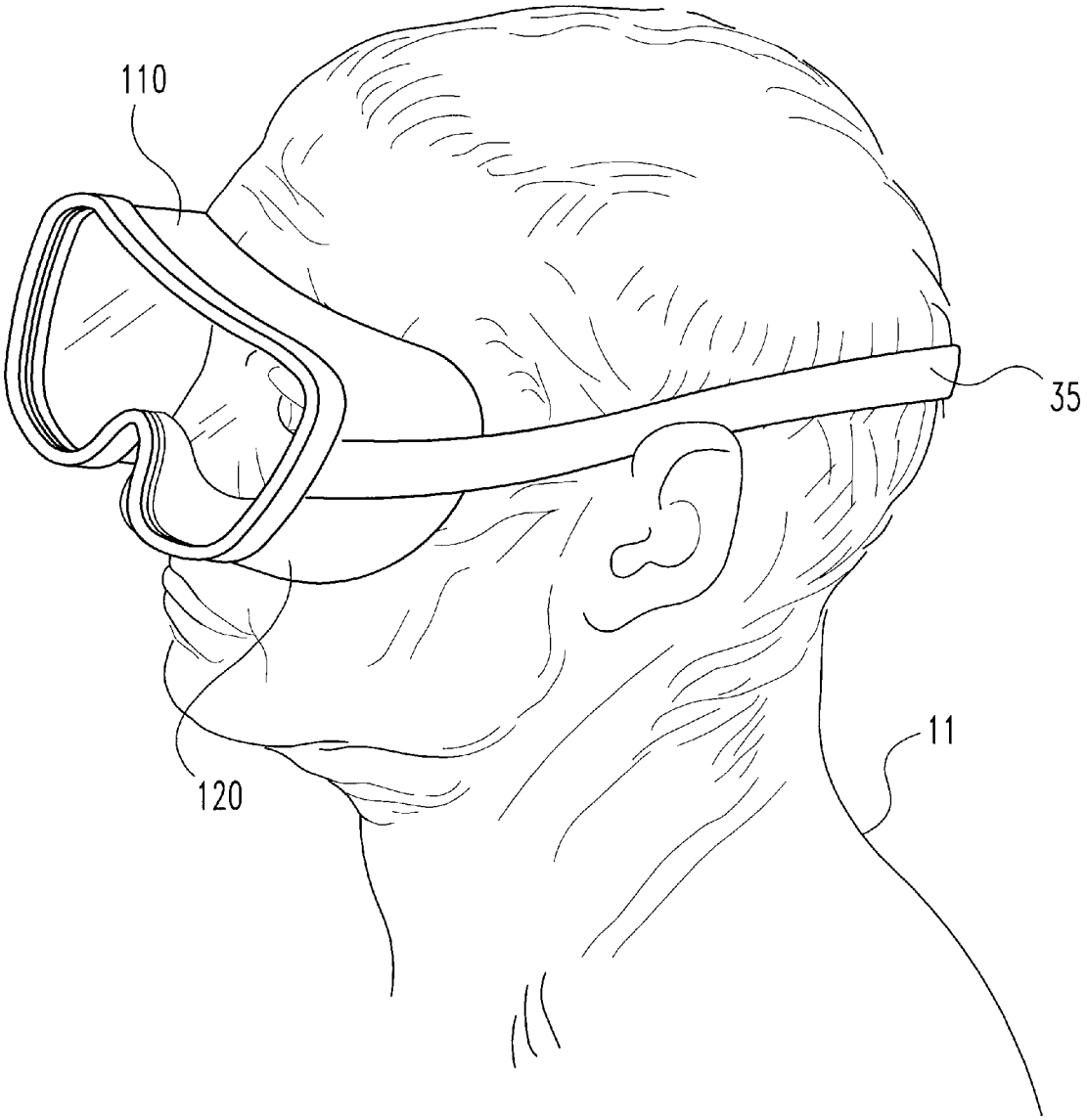
FIG. 2*a* is a perspective view of an alternative embodiment of the diving mask of the present invention.

With reference to FIG. 2*a,* there is disclosed another embodiment of the present invention, mask 110. Mask 110 is substantially similar to mask 10 and like feature numbers will be used to represent like features. The mask 110 does not enclose the nose 16 of the diver 11. The frame portion 110 is designed and constructed therefore to abut a portion of the face relative to the nose. The mask 110 includes substantially identical structure as mask 10 for directing the liquid within the mask away from the divers 11 face.

With reference to FIGS. 1–3, a method of using the mask will now be set forth. It is well known that masks often fog during use and a method is required in which to reduce and/or eliminate the fogging of the viewing portion 22. In practice, the mask can be defogged by the diver 11 adjusting the position of their body so that the the viewing portion 22 is positioned substantially horizontally and below the diver's face 12. The liquid within the reservoir 50 will then drain from the reservoir 50 onto the the viewing portion 22. The passage of the liquid over the viewing portion 22 can be utilized to clear the fogging of the mask. Further, the adjustment of the body may include, but is not limited herein to, tilting the head forward to cause the face to be disposed in a position so as to allow the liquid with the reservoir 50 to flow onto the viewing portion 22. The liquid on the viewing portion 22 can be swirled as an aid to the defogging of the viewing portion 22. The liquid on the viewing portion 22 is returned to the fluid reservoir by adjusting the position of the diver's body so that the viewing portion 22 is positioned substantially vertical and is not below the wearers face. In one form of the present invention this can be accomplished by tilting the head so as to return the face 12 back into a vertical position.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mask for wearing by a person to cover their eyes during water activities, comprising:

a frame having a first portion adapted for abutting a person's face to normally provide a substantially fluid tight enclosed single volume adjacent the face and around both eyes and a second portion spaced from said first portion;

a viewing portion coupled to said second portion of the frame, said second portion having a perimeter extending around said viewing portion; and a single continuous liquid directing member coupled to said perimeter of the frame proximate the viewing portion and extending into said substantially enclosed single volume for minimizing the movement of liquid within said enclosed single volume to the person's eyes, said continuous liquid directing member extending uninterrupted around said substantially fluid tight enclosed single volume.

2. The mask of claim 1, wherein said frame is formed of a pliable material, and wherein said viewing portion defines an uninterrupted single pane.

3. The mask of claim 2, wherein said frame having an interior surface, and wherein said liquid directing member extending around the interior surface of said frame.

4. The mask of claim 3, wherein said liquid directing member having a first portion integrally connected to said interior surface and a second portion extending substantially traverse to said interior surface and into said substantially fluid tight enclosed first volume and a third tip portion extending from said second portion back towards said interior surface.

5. The mask of claim 4, wherein:

said mask further including a strap coupled to said frame;

said same and said viewing portion forming a substantially fluid tight joint therebetween;

said frame being formed of an elastomeric material; and said liquid directing member defines a continuous single flow channel around both eyes with a substantially constant cross sectional area along said perimeter.

6. A combination, comprising:

a substantially waterproof mask having a pliable frame adapted for engaging a person's face to define a substantially fluid tight enclosed single volume adjacent the person's face and around their eyes; and a single continuous liquid accumulation reservoir within said substantially enclosed single volume for normally retaining liquid within said substantially enclosed volume so as to minimize the liquid contacting the person's face, said liquid accumulation reservoir extending uninterrupted around said substantially enclosed single volume.

7. The combination of claim 6, wherein said liquid accumulation reservoir is coupled to said frame, and wherein said liquid accumulation reservoir defining a fluid reservoir for receiving and holding a liquid within said mask.

8. The combination of claim 7, which further includes a viewing portion coupled to said frame and spaced from the person's face, and wherein said liquid accumulation reservoir extending along and adjacent said viewing portion.

9. The combination of claim 8, wherein said liquid accumulation reservoir having a portion extending into said substantially enclosed volume, and wherein said liquid accumulation reservoir is sized to hold sufficient liquid to clear said viewing portion.

10. The combination of claim 6, wherein said frame and said liquid accumulation reservoir are integrally formed.

11. The combination of claim 10, wherein said pliable material is defined by an elastomeric material, and which further includes a viewing portion coupled to said frame and spaced from the person's face, and wherein said viewing portion is received within a channel formed in said frame, said viewing portion defining a single continuous planar member adapted for protecting the person's eyes and nose.

12. The combination of claim 11 wherein said channel is formed in a thickened portion of said frame.

13. A mask for wearing by a person during water activities, comprising:

a frame adapted for abutting the person's face;

a substantially see through single planar pane mounted in one end of said frame and adapted to cover a person's eyes; and reservoir means connecting to said frame proximate said substantially see through single planar pane for normally holding liquid within an interior volume of the mask away from the person's face, said reservoir means including a single continuous liquid flow channel around said interior volume, said interior volume defining a substantially undivided space adjacent the person's face and around the person's eyes.

14. The mask of claim 13, wherein said reservoir means extending continuously and uninterrupted around the perimeter of said interior volume.

15. The mask of claim 14, wherein said reservoir means includes a tip means for reducing the cross-sectional area of a continuous opening allowing the passage of a liquid into said reservoir means.

16. The mask of claim 15, wherein said reservoir means is sized to hold at least enough liquid to clear said substantially see through pane, and wherein said reservoir means defines a single undivided source for holding a liquid to clean the substantially see through single planar pane in front of both of the person's eyes.

17. A mask for wearing by a person to cover their eyes during water activities, comprising:

a pliable frame having a first portion adapted for abutting a person's face to normally provide a single substantially fluid tight enclosed volume adjacent the face and over the person's eves and a second portion spaced from said first portion;

a viewing portion coupled to said second portion of the frame; and a continuous liquid directing member coupled to said frame proximate the viewing member and extending into said substantially enclosed volume for minimizing the movement of liquid within said single enclosed volume to the person's eyes, wherein said liquid directing member having a first end connected to said fame and a second end extending into said single substantially fluid tight enclosed volume, said second end having a tip portion that is directed back towards an interior surface of said frame, and wherein said continuous liquid directing member defining a single continuous circumferential flow channel around a perimeter of said single enclosed volume, said circumferential flow channel sized to hold a quantity of liquid for clearing said viewing portion.

18. The mask of claim 17, wherein said interior surface is adjacent and along said viewing portion, and wherein said liquid directing member extending along said interior surface.

* * * * *

UNITED STATES PATENT AND TRADEMARK OFFICE

CERTIFICATE OF CORRECTION

PATENT NO. : 6,115,848
DATED : September 12, 2000
INVENTOR(S) : Mark B. Key

It is certified that error appears in the above-identified patent and that said Letters Patent is hereby corrected as shown below:

Column 4,
Line 22, please change "same" to -- frame. --
Column 6,
Line 2, please change "eves" to -- eyes. --
Line 11, please change "fame" to -- frame. --

Signed and Sealed this

Sixth Day of November, 2001

*Attest:*

Nicholas P. Godici

*Attesting Officer*

NICHOLAS P. GODICI
*Acting Director of the United States Patent and Trademark Office*